United States Patent [19]

Becker et al.

[11] Patent Number: 4,850,924

[45] Date of Patent: Jul. 25, 1989

[54] LOW-PROFILE ROLLING BOOK FOR CHILDREN

[76] Inventors: James F. Becker, 145 Hart Ave.; Andrew S. Mayer, 135 Wadsworth Ave., both of Santa Monica, Calif. 90405

[21] Appl. No.: 197,267

[22] Filed: May 23, 1988

[51] Int. Cl.[4] ..... A63H 33/00; A63H 33/16; A63H 7/00; B42D 5/00

[52] U.S. Cl. ..... 446/71; 446/80; 446/269; 271/15.1

[58] Field of Search ..... 446/71, 78, 77, 86, 446/147, 269, 431, 432, 487, 488, 491, 465, 469; 281/1, 15 R, 29; 280/35, 639

[56] References Cited

U.S. PATENT DOCUMENTS

| | | | |
|---|---|---|---|
| 2,933,325 | 4/1960 | Akins | 280/35 |
| 2,971,768 | 2/1961 | Ackley et al. | 280/35 |
| 3,208,772 | 9/1965 | Dahlstrand et al. | 281/15 R X |
| 3,711,989 | 1/1973 | Nielsen et al. | 446/469 |
| 3,831,832 | 8/1974 | Gray | 446/78 |
| 4,597,743 | 7/1986 | Becker et al. | 446/71 |
| 4,694,209 | 9/1987 | Shindou | 446/469 X |
| 4,753,346 | 6/1988 | Tsuji | 446/78 X |

FOREIGN PATENT DOCUMENTS

| | | | |
|---|---|---|---|
| 1278081 | 6/1972 | United Kingdom | 446/469 |

OTHER PUBLICATIONS

A book showing a truck with the name "Ernie and Bert's Delivery Service", bearing a copyright notice dated 1983 by Children's Television Workshop, Inc.

A book showing a truck with the name "Little Cement Mixer, Beep Beep Board Books #2", bearing a copyright notice dated 1983 by Simon and Schuster.

A brochure showing various books depicting a fire engine, a truck, and a train by Tuffy Books, Inc.

*Primary Examiner*—Robert A. Hafer
*Assistant Examiner*—D. Neal Muir
*Attorney, Agent, or Firm*—Knobbe, Martens, Olson & Bear

[57] ABSTRACT

A low profile rolling book comprising plural sheets, bound along one marginal edge. In the preferred embodiment, the book's front cover includes printed matter depicting the top view of a wheeled vehicle having wheel wells disposed adjacent the parallel opposing top and bottom edges of the book. Respective wheels are rotatably mounted at each of the wheel wells.

14 Claims, 1 Drawing Sheet

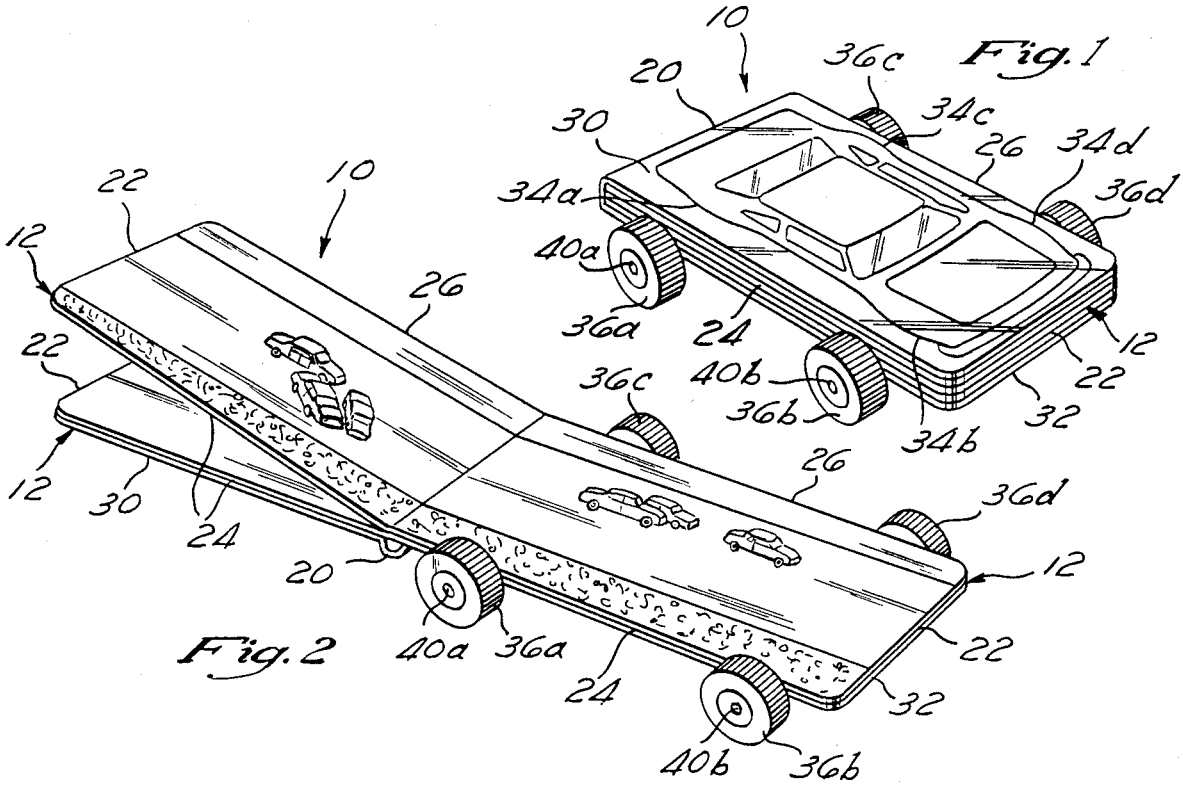
10
20
36c
34c
30
26
34d
36d
34a
40a
36a
24
40b
36b
34b
32
12
22
Fig. 1
Fig. 2
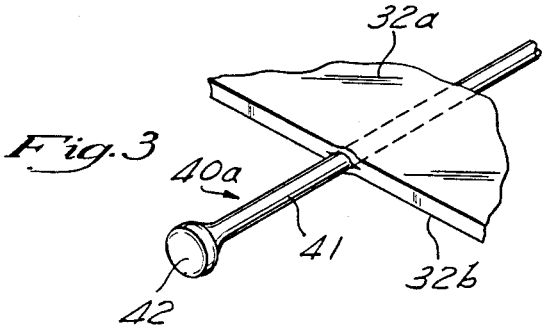
32a
Fig. 3
40a
41
32b
42
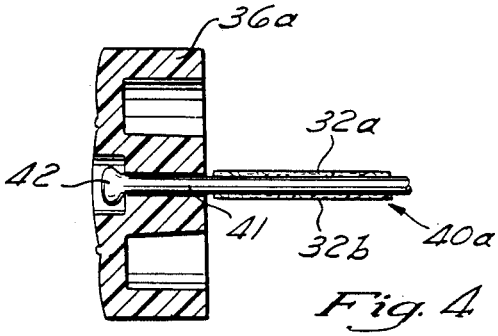
36a
32a
42
41
32b
40a
Fig. 4

LOW-PROFILE ROLLING BOOK FOR CHILDREN

BACKGROUND OF THE INVENTION

The present invention relates to children's books, particularly those employing entertaining features.

It is often difficult to capture and maintain young children's interest in reading books. The prior art has addressed this problem by designing visually entertaining books for children. Visually entertaining features may capture a child's interest initially, but a book having mechanical features allowing it to function as a toy is needed to maintain that interest.

SUMMARY OF THE INVENTION

The present invention comprises a book having printed matter on the front cover depicting the top view of a wheeled vehicle or other moving object. The vehicle or object depicted by the printed matter has support locations where the vehicle or object is normally supported on the ground. In the case of a wheeled vehicle, the support locations comprise the wheel wells of the vehicle.

The book of the present invention also includes plural wheels, each of which is rotatably mounted at a support location depicted by the printed matter. The wheels are mounted to project from the top and bottom edges of the book. In the preferred embodiment, corresponding opposing wheels are mounted on a common axle coplanar with and embedded within the back cover, i.e., the front wheels on one axle and the rear wheels on another. This mounting is such that the book can be opened to expose the internal pages without interference from the wheels, and when the book is laid flat, it rolls freely upon the wheels.

In the preferred embodiment, the front and back covers and the internal pages are all the same size and thickness. Further, the height of the wheels and the thickness of the back cover, within which the wheels' axles are embedded, are selected so as to provide sufficient ground clearance for the book to be free-standing and self-rolling. In other words, the book stands on its own wheels with no external support, and rolls freely on its own wheels when pushed or placed on an inclined plane. These free-standing and self-rolling features promote enjoyment of the book by children.

BRIEF DESCRIPTION OF THE DRAWINGS

FIG. 1 is a perspective view of the book of the present invention, showing the printed matter on the front cover, with the book in a closed condition for rolling.

FIG. 2 is a perspective view of the book showing the book in an open condition for exposing the internal pages for reading.

FIG. 3 is an enlarged view showing the manner in which the axle is mounted in the rear cover.

FIG. 4 is a cross-sectional view of the wheel and axle assembly showing the manner in which the wheel is mounted on the axle.

DESCRIPTION OF THE PREFERRED EMBODIMENT

As shown in FIGS. 1 and 2, the low-profile rolling book 10 of the present invention comprises plural, generally rectangular sheets 12, each having four marginal edges, 20, 22, 24 and 26 with the edges 20 and 22 forming the sides of the book 10, and the edges 24 and 26 forming the bottom and top, respectively, of the book

10. The sheets 12 of the book 10 are bound, e.g., along the marginal edges 20. In the embodiment shown, the sheets 12 of the book 10 are structurally identical. By way of specific example, the surfaces of the sheets 12 may be about 4½ inches in length by 2½ inches in width and the sheets 12 may be formed from 1/16-inch cardboard.

The two outermost sheets 12 form a front cover 30 and a rear cover 32, while the internal sheets form the pages of the book 10. The exterior surface of the front cover 30 has printed matter thereon depicting a moving object, which, in the preferred embodiment, comprises a vehicle 33. Although the printed matter 33 in the embodiment disclosed comprises an automobile, it will be understood that other types of vehicles, such as trucks, fire engines and sleds may be alternatively depicted. Further, it will be recognized that printed matter 33 may alternatively comprise moving obects other than vehicles, such as animals. Regardless of the type of moving object depicted, the printed matter 33 includes support locations for supporting the moving object on the ground. The support locations on the front cover 30 are designated generally in FIG. 1 by the referenced numerals 34*a*, 34*b*, 34*c* and 34*d*. In the case of a wheeled vehicle, the support locations 34 comprise the wheel wells (e.g., fenders) of the wheeled vehicle. In the case of a non-wheeled vehicle, such as a sled, the support locations comprise the normal ground contact points, that is, the runners of the sled. In the case of an animal, the support locations 34 comprise the feet of the animal. In all cases, however, the printed matter is disposed so that the support locations 34 are located adjacent the bottom and top marginal edges 24, 26. Further, the bottom and top marginal edges 24, 26 are preferably longer than the side marginal edges 20, 22.

As shown in FIGS. 1 and 2, the book 10 of the present invention includes wheels 36*a*, 36*b*, 36*c*, 36*d*, which are mounted at the support locations 34*a*, 34*b*, 34*c*, 34*d*, respectively, on the rear cover 32. The wheels 36*a*, 36*c* are mounted directly opposite each other on a common shaft 40*a* and rotate freely so as to form a rear wheel pair for the vehicle 33, and the wheels 36*b*, 36*d* are mounted directly opposite each other on a common shaft 40b and rotate freely so as to form a front wheel pair for the vehicle 33. The front wheels 36*b*, 36*d* thus rotate about an axis of rotation collinear with the shaft 40*b*, while the rear wheels 36*a*, 36*c* rotate about an axis of rotation collinear with the shaft 40*a*.

The shafts 40*a*, 40*b* are embedded within the rear cover 32 in a parallel relationship, as illustrated in FIGS. 2, 3 and 4, such that the axes of rotation of the wheels 36 are parallel to and coplanar with the surface of the rear cover 32. Although only the rear shaft 40*a* and right rear wheel 36*a* are depicted in FIGS. 3 and 4, it will be understood that the front shaft 40*b* and the remaining wheels 36*b*, 36*c* 36*d* are mounted in the same manner as shown and described.

The rear cover 32 comprises a top subsheet 32*a* and a bottom subsheet 32*b* which are glued together. Prior to gluing the subsheets 32*a*, 32*b* together to form the rear cover 32, crease lines are scored on the inner surface of the bottom subsheet 32*b* such that their end points coincide with support locations 34. This provides grooves for positioning the shafts 40. The shafts 40 are placed within these grooves, and the subsheets 32*a*, 32*b* are then glued together with the shafts 40 therebetween, thereby rigidly, immovably embedding the shafts 40 within the rear cover 32. The shafts 40 are longer than the side marginal edges 20, 22, so as to form two pairs of axles 41 which project outwardly from the bottom and top marginal edges 24, 26, respectively, of the rear cover 32. Each end of each axle 41 includes a retainer portion 42, formed for example by deforming the ends of the shafts in the shape of a knob so as to prevent the wheels 36 from sliding off their respective axles 41. As seen in FIG. 4, the diameter of the center hole 38 of the wheel 36*a* is larger than the outer diameter of the axle 41, and yet smaller than the diameter of the retainer portion 42 of the axle 40*a*. By mounting all of the wheels 36 in this manner, the wheels 36 will rotate freely and be retained on their respective axles 41.

Preferably, the wheels 36 are installed on the shafts 40 prior to embedding the shafts 40 within the rear cover 32. Each shaft 40*a*, 40*b* is precut to the appropriate length, and one end of each shaft 40*a*, 40*b* is enlarged or deformed (e.g., by a stamping machine) to form respective retainer portions 42. The wheels 36 are installed on the shafts 40 by inserting the non-deformed end of each shaft 40*a*, 40*b* through the center holes 38 of a pair of the wheels 36. The other ends of the shafts 40 are then enlarged or deformed to form retainer portions 42. The wheels 36 are positioned at the opposite ends of their respective shafts 40, and the shafts 40 are then embedded within the rear cover 32 as described above.

The diameter of the wheels 36 as compared to the thickness of the rear cover 32 in which the axles 41 are embedded is such that the invention is free-standing and self-rolling. The radii of the wheels 36 are preferably equal, and a preferred radius for each of the wheels 36 is one which is approximately equal to or less than the combined thickness of the sheets 12. A preferred clearance distance between the rear cover 32 and the surface on which the wheels 36 rest is approximately ½-inch.

The present invention thus not only provides an attractive book, but also a functioning, realistic toy which may be enjoyed by a child apart from the textual matter in the book. This not only enhances the child's interest in the book, but also enhances his enjoyment of the book.

What is claimed is:

1. A low-profile rolling book, comprising:

plural sheets, bound along one marginal edge to form said book, said sheets including a front cover and a rear cover with internal pages therebetween;

printed matter, disposed on a surface of at least one of said covers, depicting a moving object having support locations, said support locations disposed adjacent the marginal edges of at least one of said covers;

plural wheels, for supporting said sheets in a free-standing position when all of said sheets are horizontal and in contact with adjacent sheets such that said book is in a closed position, at least some of said wheels disposed at respective support locations depicted by said printed matter; and plural axles for mounting said plural wheels to rotate about respective axes of rotation, said axes of rotation being parallel to a surface of at least one of said sheets.

2. A low-profile rolling book as defined by claim 1, wherein said moving object depicted by said printed matter comprises a wheeled vehicle, and said wheel locations depicted by said printed matter comprise wheel wells of said wheeled vehicle.

3. A low-profile rolling book as defined by claim 1, wherein said front cover, rear cover and internal pages have the same dimensions.

4. A low-profile rolling book as defined by claim 1, wherein said plural sheets are comprised of cardboard.

5. A low-profile rolling book as defined by claim 1, wherein said axles are mounted so as to project from one of said covers.

6. A low-profile rolling book as defined by claim 1, Wherein said plural sheets are bound along a marginal edge parallel to said axes of rotation.

7. A low-profile rolling book as defined by claim 1, wherein said sheets have a marginal edge parallel to said axes of rotation and a marginal edge normal to said axes of rotation, the marginal edge normal to said axes of rotation being significantly longer than the marginal edge parallel to said axes of rotation.

8. A low-profile rolling book as defined by claim. 1, wherein said plural wheels comprise four wheels, two of which are mounted on the bottom edge of said rear cover and two of which are mounted on the top edge of said rear cover, one of said wheels on said bottom edge disposed opposite to one of said wheels on the top edge to provide a front wheel pair, and the other of said wheels on the bottom edge disposed opposite to the other of said wheels on the top edge to provide a rear wheel pair.

9. A low-profile rolling book as defined by claim 8, wherein oppositely disposed wheels are mounted on respective common shafts.

10. A low-profile rolling book as defined by claim 9, wherein each end of said shafts is larger in diameter than an inner diameter of a center hole of each said respective wheels.

11. A low-profile rolling book as defined by claim 1, wherein each of said common shafts is embedded within one of said covers.

12. A low-profile rolling book as defined by claim 9, wherein said shafts are longer than said marginal edges parallel to said axes of rotation.

13. A low-profile rolling book as defined by claim 1, wherein said wheels are of equal radii and each of said, radii is approximately equal to or less than the combined thickness of said sheets.

14. A low-profile rolling book as defined by claim 1, wherein the ground clearance distance between said rear cover and a surface on which said wheels rest is no greater than ½-inch.

* * * * *